US006540061B1

(12) United States Patent
Focke et al.

(10) Patent No.: US 6,540,061 B1
(45) Date of Patent: Apr. 1, 2003

(54) PROCESS AND APPARATUS FOR CONVEYING CIGARETTES

(75) Inventors: Heinz Focke, Verden (DE); Henry Buse, Visselhövede (DE); Irmin Steinkamp, Seevetal (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/483,690

(22) Filed: Jan. 14, 2000

(30) Foreign Application Priority Data

Jan. 15, 1999 (DE) ..... 199 01 248

(51) Int. Cl.[7] ..... B65G 37/00
(52) U.S. Cl. ..... 198/359; 198/347
(58) Field of Search ..... 53/151, 536; 198/359, 198/347, 418.1, 448, 443

(56) References Cited

U.S. PATENT DOCUMENTS

| | | | | | |
|---|---|---|---|---|---|
| 2,682,983 | A | * | 7/1954 | Ashcroft | 198/418.1 |
| 3,106,282 | A | * | 10/1963 | Schmermund | 198/418.1 |
| 3,565,237 | A | * | 2/1971 | Strydom | 131/282 |
| 3,854,611 | A | | 12/1974 | Wahle | |
| 3,917,049 | A | * | 11/1975 | Shirai et al. | 53/151 X |
| 3,948,276 | A | * | 4/1976 | Prandini | 131/283 |
| 4,231,461 | A | * | 11/1980 | Hinchcliffe et al. | 198/347.3 |
| 4,328,886 | A | * | 5/1982 | Seragnoli | 198/347.3 |
| 4,336,873 | A | * | 6/1982 | Focke | 198/347 |
| 4,365,703 | A | * | 12/1982 | Hinchcliffe et al. | 198/347 |
| 4,366,895 | A | * | 1/1983 | Bennett et al. | 198/347.1 |
| 4,421,223 | A | * | 12/1983 | Molins et al. | 198/347 X |
| 4,455,117 | A | * | 6/1984 | Cartoceti | 414/295 |
| 4,580,939 | A | * | 4/1986 | Dyett et al. | 131/55 |
| 4,700,825 | A | * | 10/1987 | Mattei et al. | 198/418.3 |
| 4,717,009 | A | * | 1/1988 | Carter et al. | 198/347.1 |
| 4,735,032 | A | * | 4/1988 | Focke | 53/149 |
| 4,790,333 | A | * | 12/1988 | Focke et al. | 131/283 |
| 4,856,958 | A | | 8/1989 | Bantien | |
| 4,962,629 | A | * | 10/1990 | Focke | 209/536 |
| 5,464,027 | A | * | 11/1995 | Bina et al. | 131/282 |
| 5,617,943 | A | * | 4/1997 | Belvederi et al. | 198/418.1 |
| 5,718,102 | A | * | 2/1998 | Draghetti | 131/283 |
| 5,743,067 | A | * | 4/1998 | Trimani | 131/282 |
| 6,311,827 | B1 | * | 11/2001 | Draghetti | 198/418.1 |

FOREIGN PATENT DOCUMENTS

| | | | |
|---|---|---|---|
| DE | 1066118 | * | 9/1959 |
| DE | 371388 | | 9/1963 |
| DE | 1917977 | * | 10/1970 |
| DE | 2347674 | * | 4/1974 |
| DE | 3028982 | * | 2/1981 |
| DE | 3121353 | * | 4/1982 |
| DE | 3713509 | * | 10/1987 |
| DE | 4127283 | * | 2/1993 |
| GB | 877876 | | 9/1961 |
| GB | 904429 | * | 8/1962 |
| GB | 911942 | * | 12/1962 |
| GB | 1200388 | | 7/1970 |
| GB | 1594941 | | 8/1981 |

OTHER PUBLICATIONS

European Search Report dated Apr. 18, 2000.

* cited by examiner

*Primary Examiner*—Christopher P Ellis
*Assistant Examiner*—Richard Ridley
(74) *Attorney, Agent, or Firm*—Abelman, Frayne & Schwab

(57) ABSTRACT

In the handling of cigarettes in the region of a cigarette-packaging machine or the like, the first filling operation of containers, conveying sections and cigarette magazine (12) is problematic because the cigarettes (21) are conveyed largely under their own weight during operation of the installation. In order to avoid impairment of the cigarettes as the installation is filled therewith, the containers, conveying sections and the cigarette magazine are assigned supporting and guide elements which are moved downwards or horizontally within the (empty) spaces in accordance with the filling operation, with the result that the cigarettes pass into the corresponding space with support and guidance.

11 Claims, 10 Drawing Sheets

Figure 1:
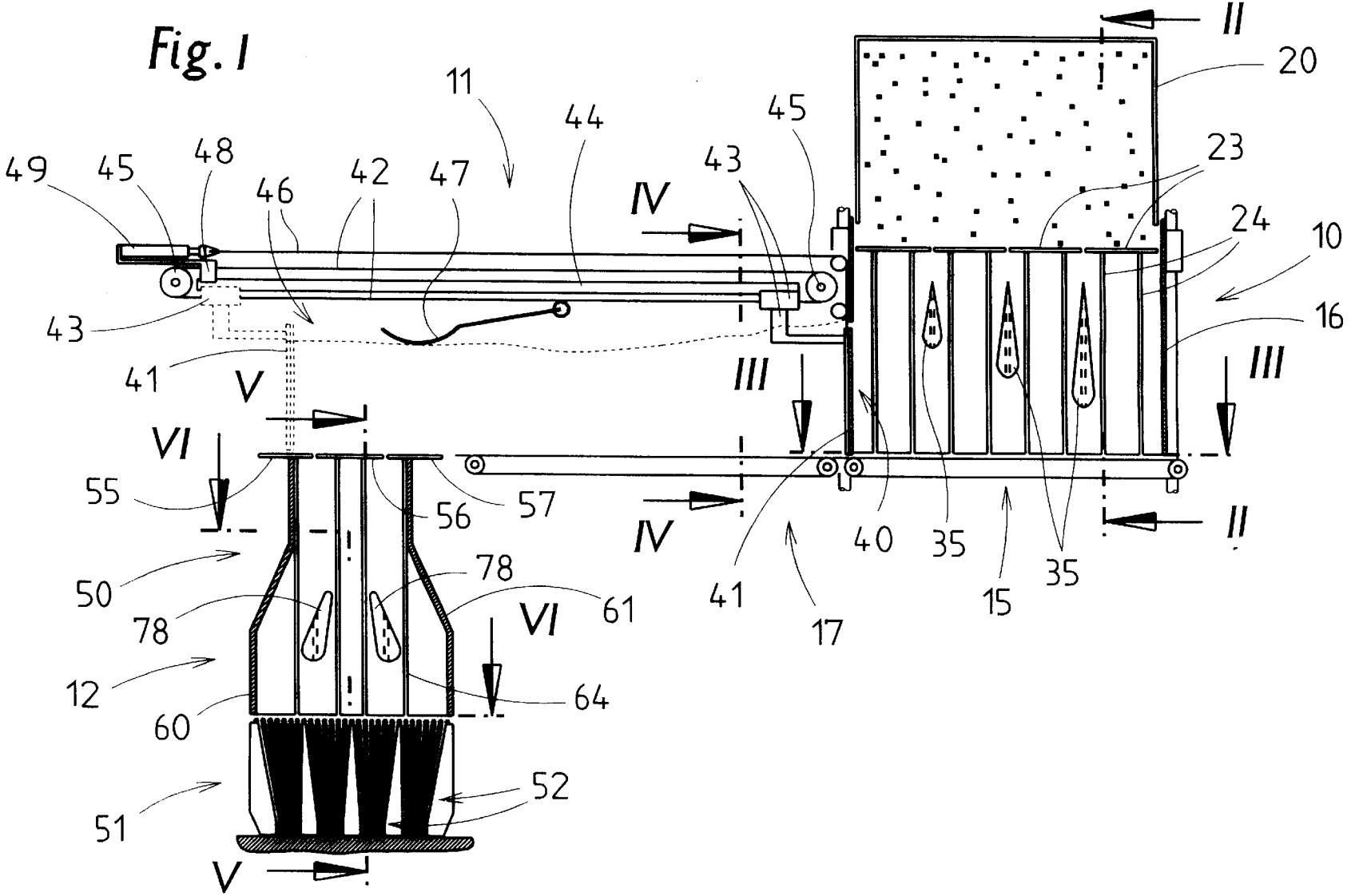

20
21
22
34
30
23
34
13
14
28
36
31
37
33
10
34
35
28
23
34
15

12
78
58
81
80
79
67
50
72
62
70
65
73
59
63
VII
71
IX
VII
66
100
55/56/57
92
93
94
83
91
86
99
IX
84
54
96
51
86
59
129
83

72
73
86
99
51
61
65
88
84
54
53
50
83
85
VIII
88
89
100
85
83
54
53
52

50
63
58
100
88
86
89
90
90
87
84
55/56/57
51
83
54
59

101
114
112
102
103
110
115
116
121
117
108

122
115
123
104
105
118
119
120
111
116
101
124
114
110
103
103
106
107
101
109
114
115
XI
117
116
104
118
117
113
114
102
103
106
119
124
118
XI 12
132
128
126
130
51
126
50

12
125
127
130
131
128
51
125

PROCESS AND APPARATUS FOR CONVEYING CIGARETTES

The invention relates to a process for introducing cigarettes or a cigarette stream into a chamber, a container, a space, channels or the like, the cigarettes being transported under their own weight and/or by conveying elements. The invention also relates to an apparatus for carrying out the process.

Cigarettes are predominantly transported under their own weight in the region of cigarette-production machines and packaging machines. In the case of a conventional arrangement, the cigarettes coming from the cigarette-production machine or from a storage are introduced into a collecting container from above, then transported along a horizontal conveying section and subsequently conveyed into a cigarette magazine from above. The latter is a standard constituent part of a packaging machine. In the bottom region, the cigarette magazine merges into groups of shafts located one beside the other. At the bottom end of these upright channels, the cigarettes are removed in groups, that is to say are pushed out for transfer to the packaging elements.

The operation of starting up the packaging machine, that is to say the introduction of the cigarettes into the empty collecting containers, conveying regions and into the cigarette magazine, is problematic. The cigarettes are impaired mechanically by dropping movements and disordered conveying movements. Furthermore, there is considerable incorrect positioning of individual cigarettes. The same problem arises with cigarettes being conveyed along horizontal or upright cigarette conveyors.

The object of the invention is to configure the operation of introducing or conveying cigarettes into (collecting) containers, chambers, channels or shafts, etc. such that the cigarettes are conveyed with the avoidance of mechanical loading and incorrect positioning.

In order to achieve this object, the process according to the invention is characterized in that, in terms of the free receiving volume, the chamber or the space or container for receiving the cigarettes is enlarged continuously or cyclically in accordance with the feed of cigarettes, such that the free space for receiving the cigarettes corresponds essentially to the fed quantity of cigarettes.

Accordingly, the solution according to the invention prevents the situation where the cigarettes pass, or are conveyed (horizontally and vertically), into a container in free fall or without guidance or are subjected to a free-fall movement in upright shafts. Rather, according to the invention, moveable guide elements pass into the containers, chambers, channels, etc. and are moved in the conveying direction of the cigarettes in accordance with the filling operation, this resulting in a gradual filling operation for the relevant space. Once all the spaces, chambers, containers and channels have been completely filled, the guide elements are moved into a position outside these spaces. As operation continues, the cigarette stream is conveyed in an uninterrupted and continuous manner without guide elements in the sense of the invention.

In the case of the apparatus according to the invention, horizontally directed guide plates pass into a collecting container for cigarettes. The cigarettes are introduced into the collecting container from above. The guide plates are moved downwards in accordance with the filling operation.

Analogously, a boundary element, namely a boundary wall, is moved along a horizontal conveying section of the cigarettes, to be precise in accordance with the gradual filling of this conveying section.

Furthermore, according to the invention, a cigarette magazine is provided with cigarette guide elements which can be moved from top to bottom, namely with guide webs. Provided in the region of the shafts of the magazine are supporting fingers or carrying bars, which pass into each shaft.

The guide or boundary elements are of predominantly comb-like design, with the result that the elements can be moved past functional elements of correspondingly comb-like design within the containers.

In the case of a cigarette conveyor for transporting a cigarette stream, for example, from the maker to the packer, the invention provides an auxiliary element which either, at the beginning of a filling operation, runs in front of the cigarette stream and supports the same or, as the cigarette conveyors come to an end, supports and guides the end of the cigarette stream.

Figure 2:
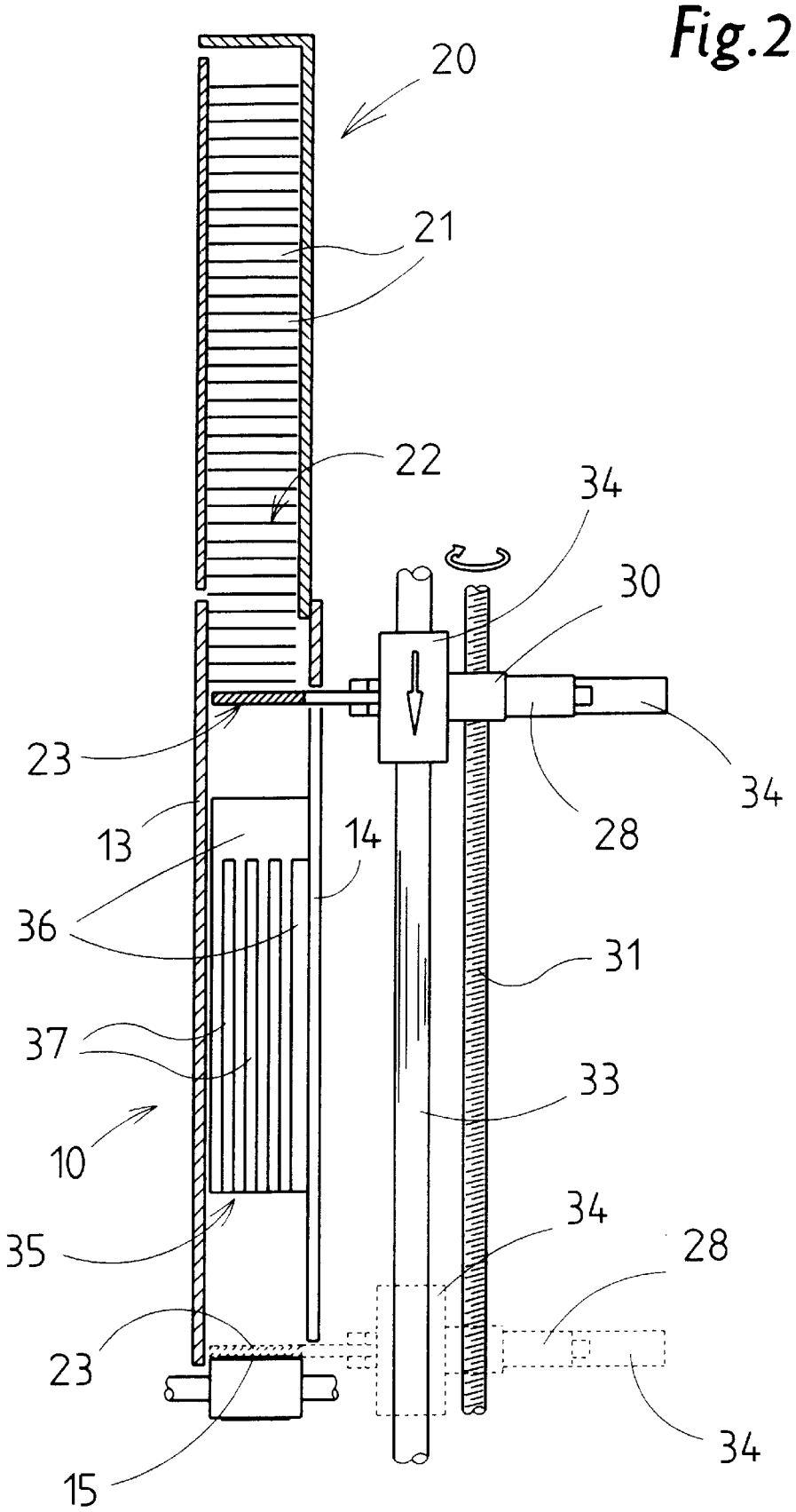
Figure 3:
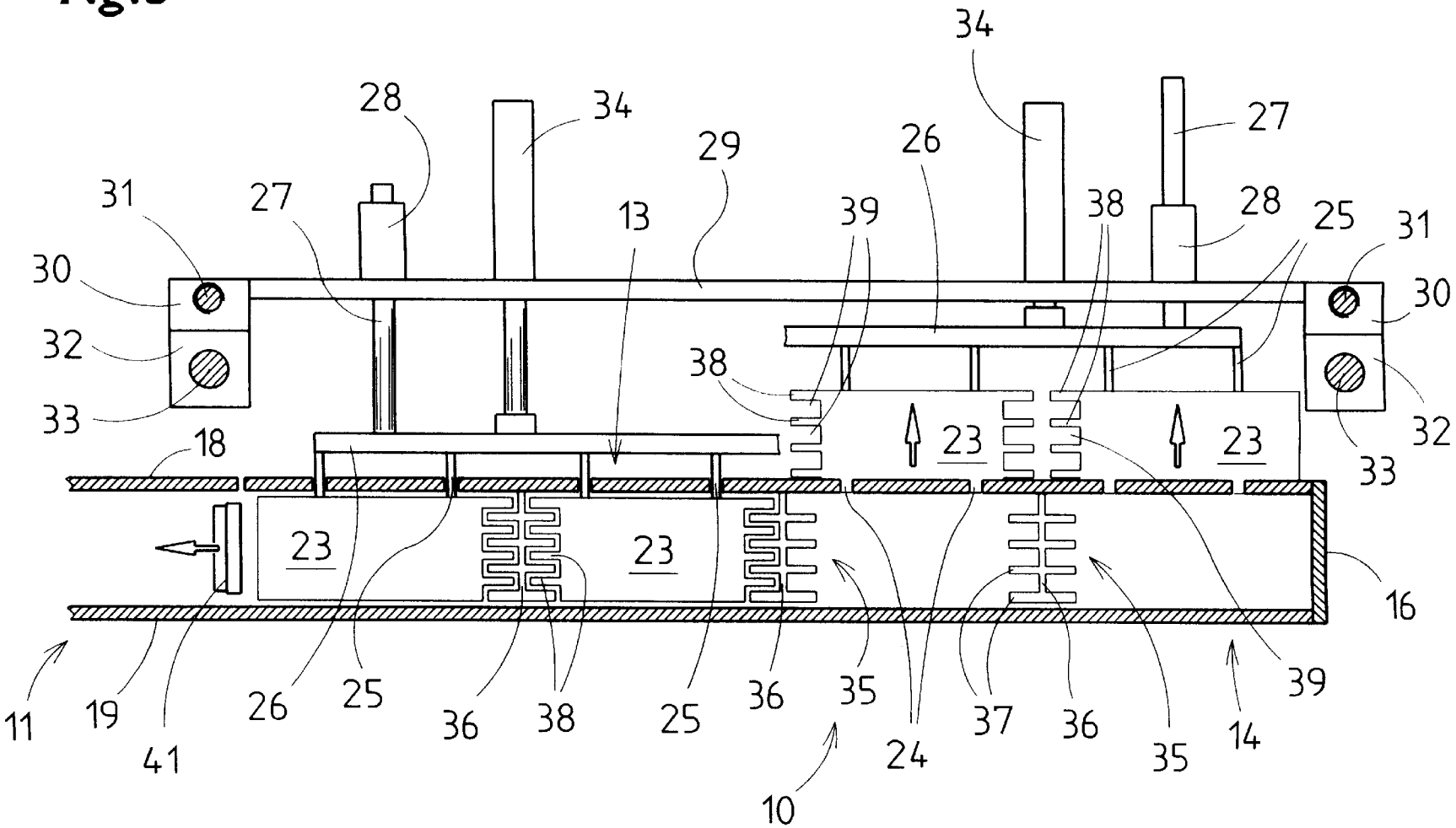
Figure 4:
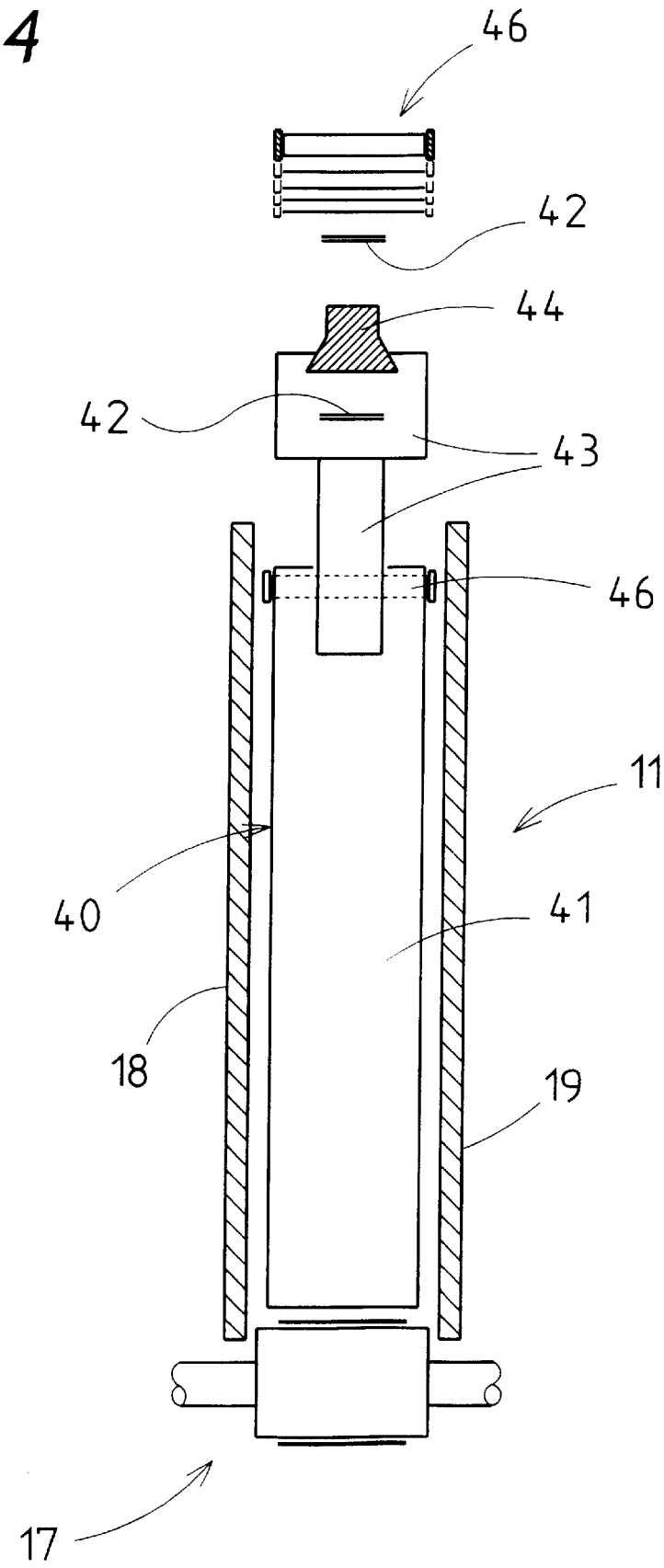
Figure 5:
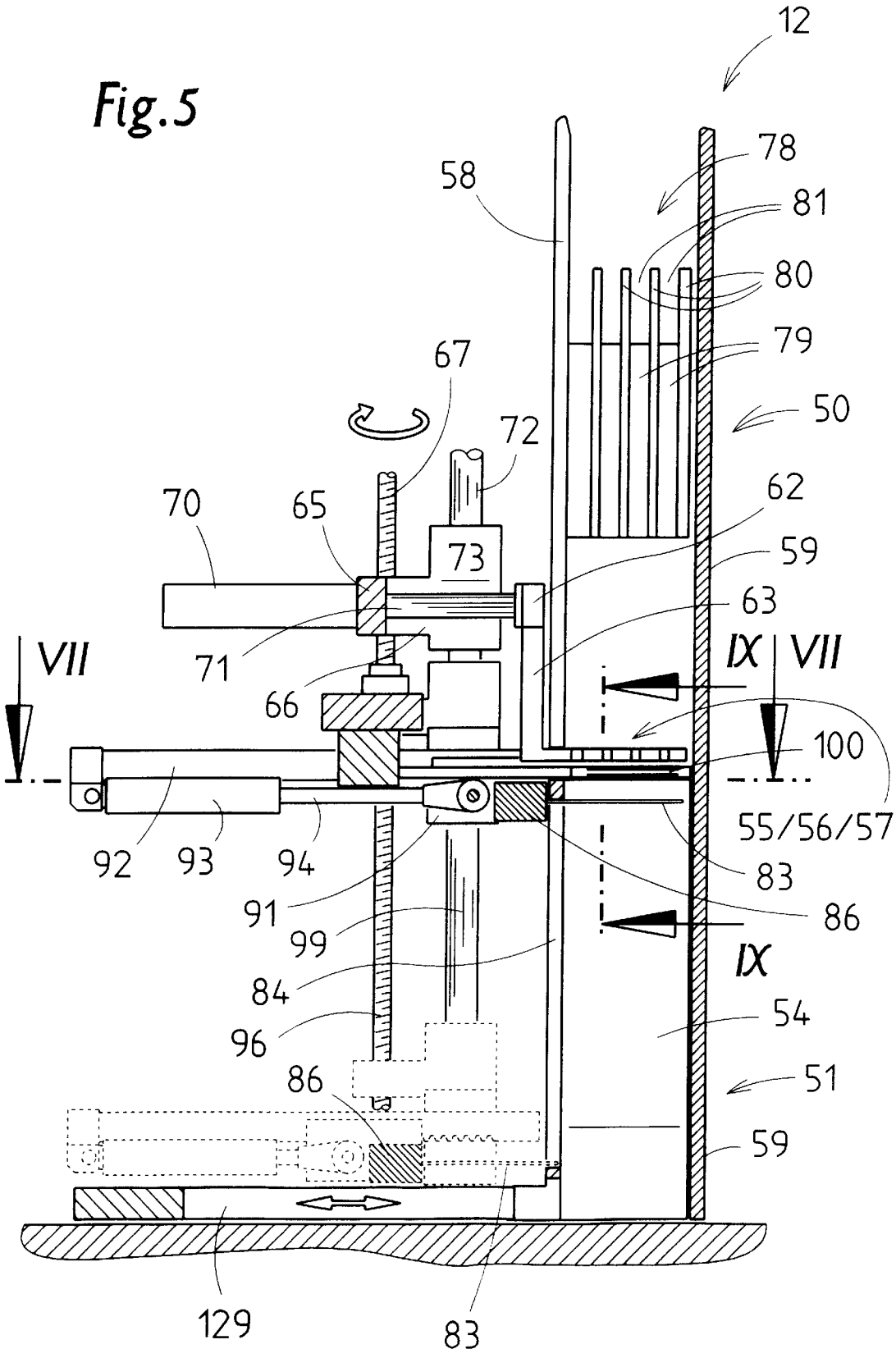
Figure 6:
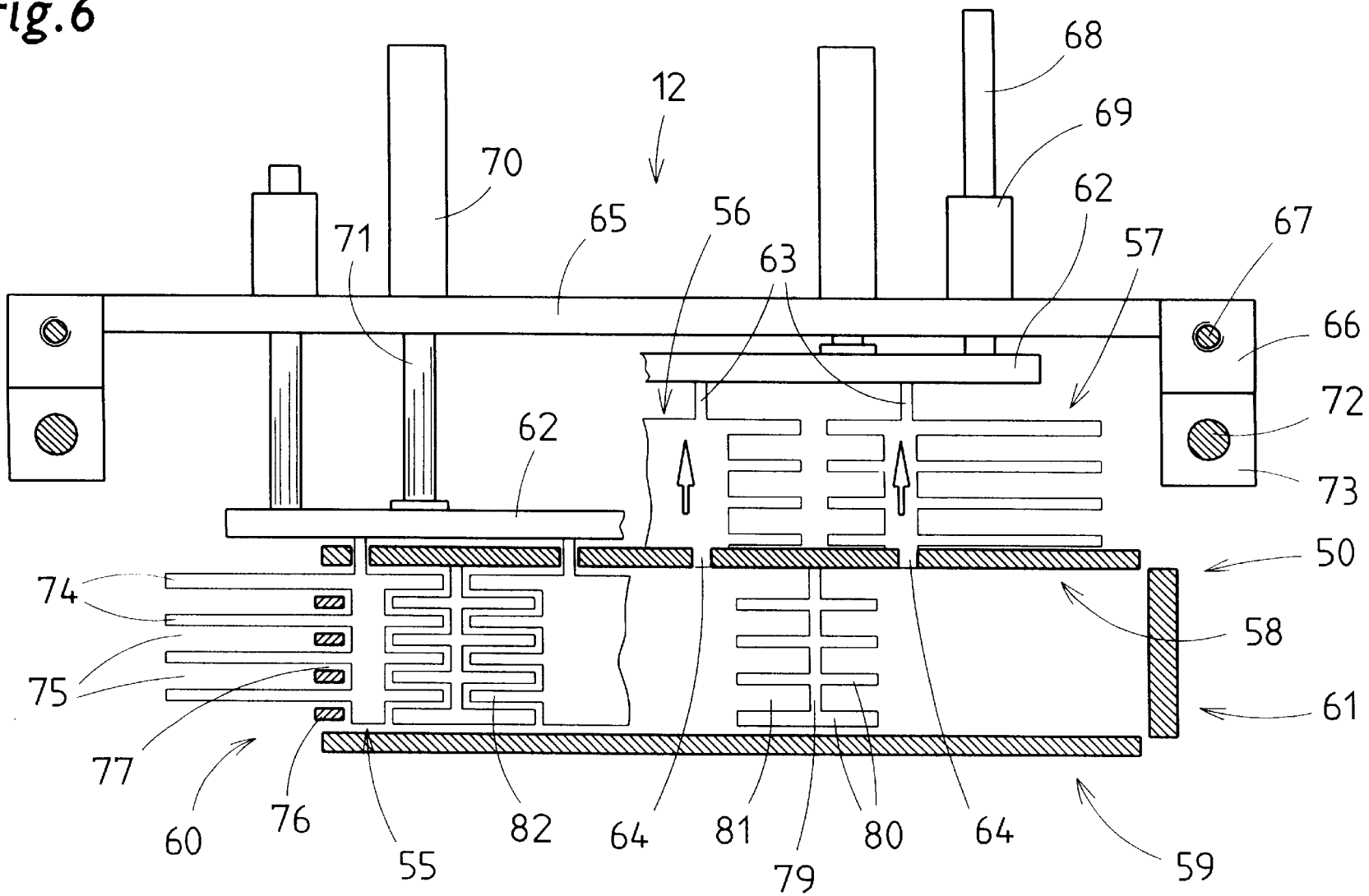
Figure 7:
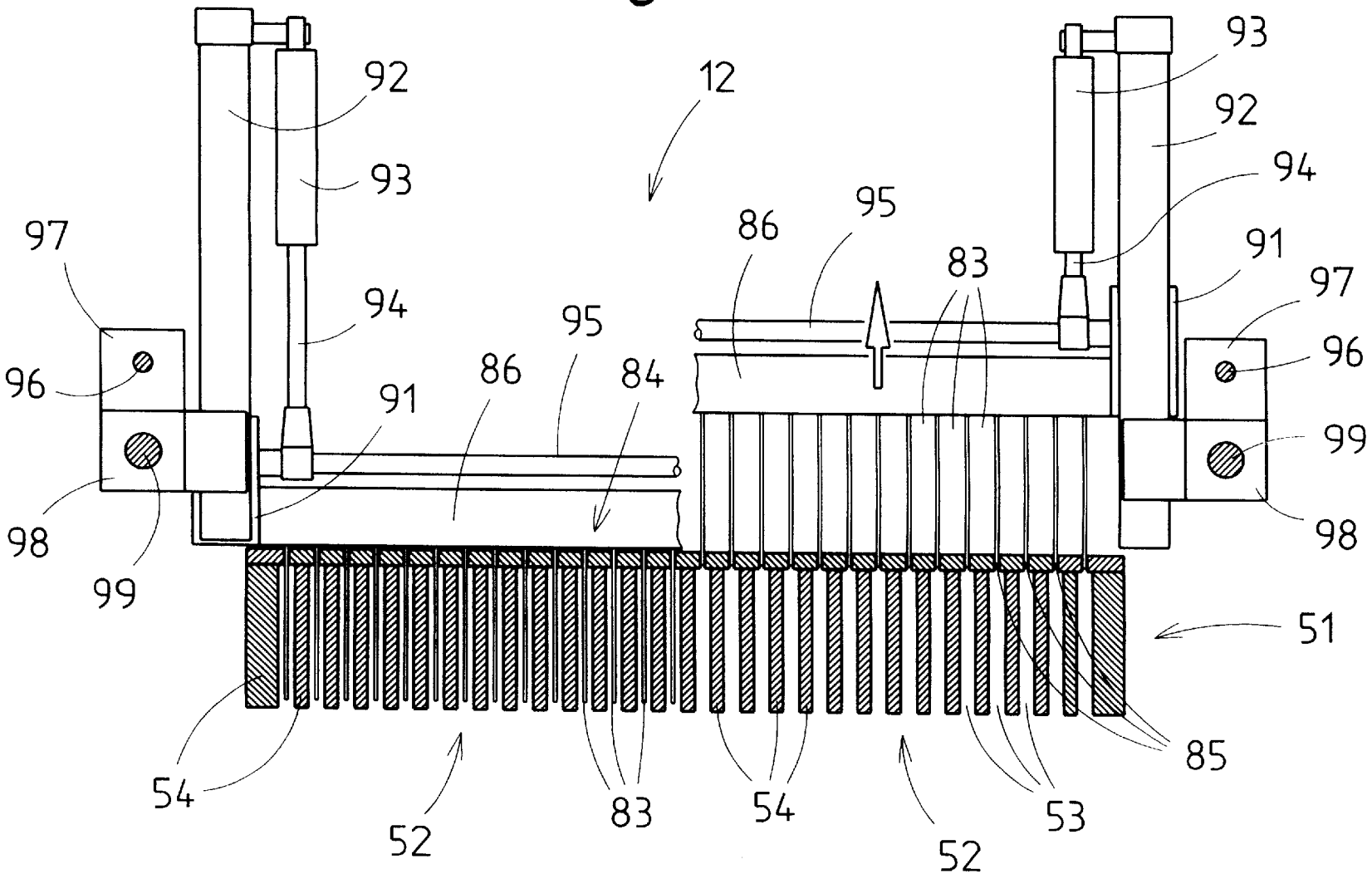
Figure 9:
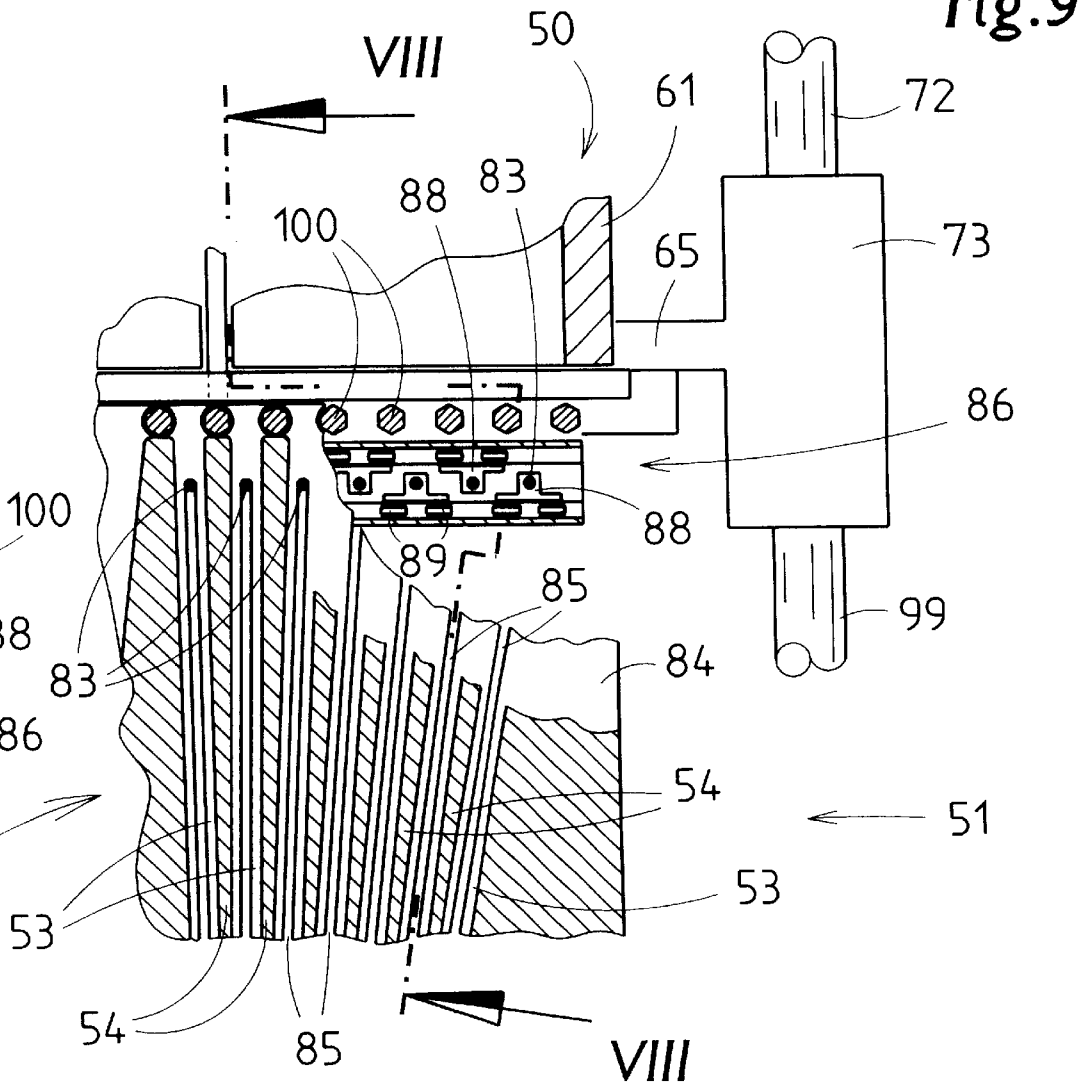
Figure 8:
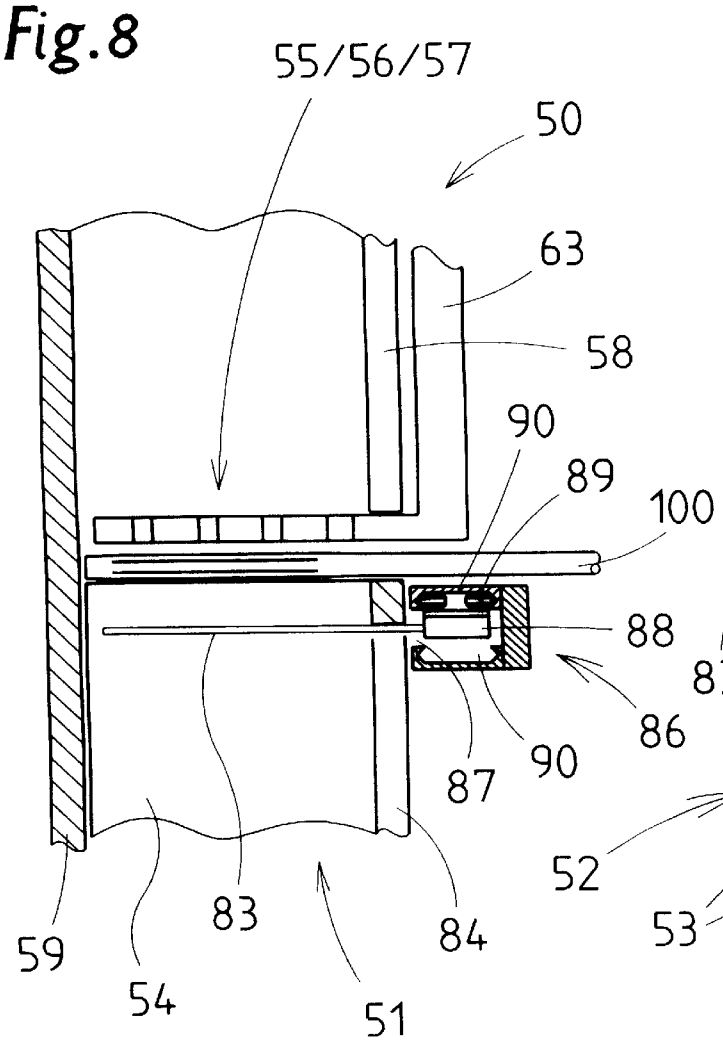
Figures 10, 11:
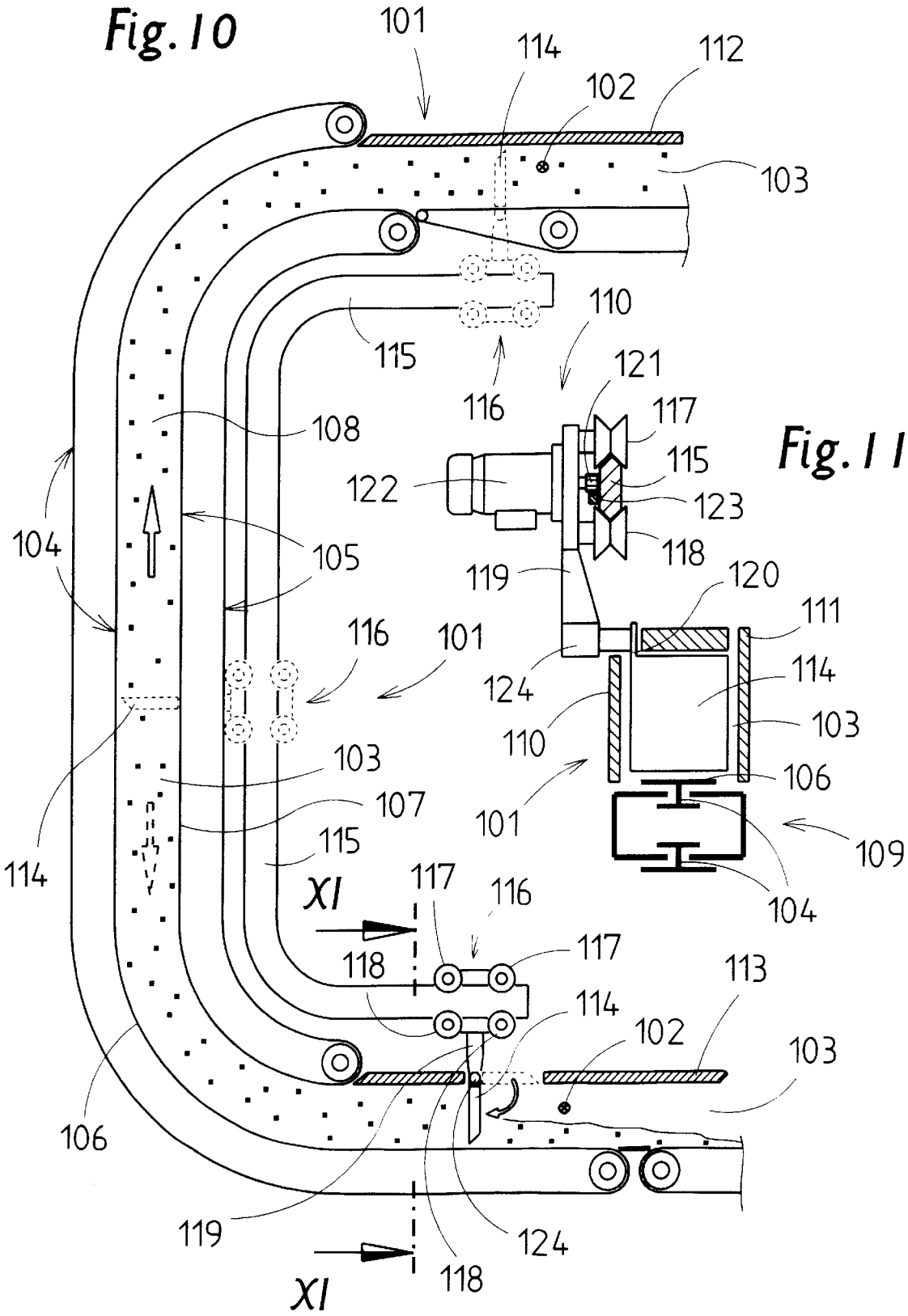
Figures 12, 13:
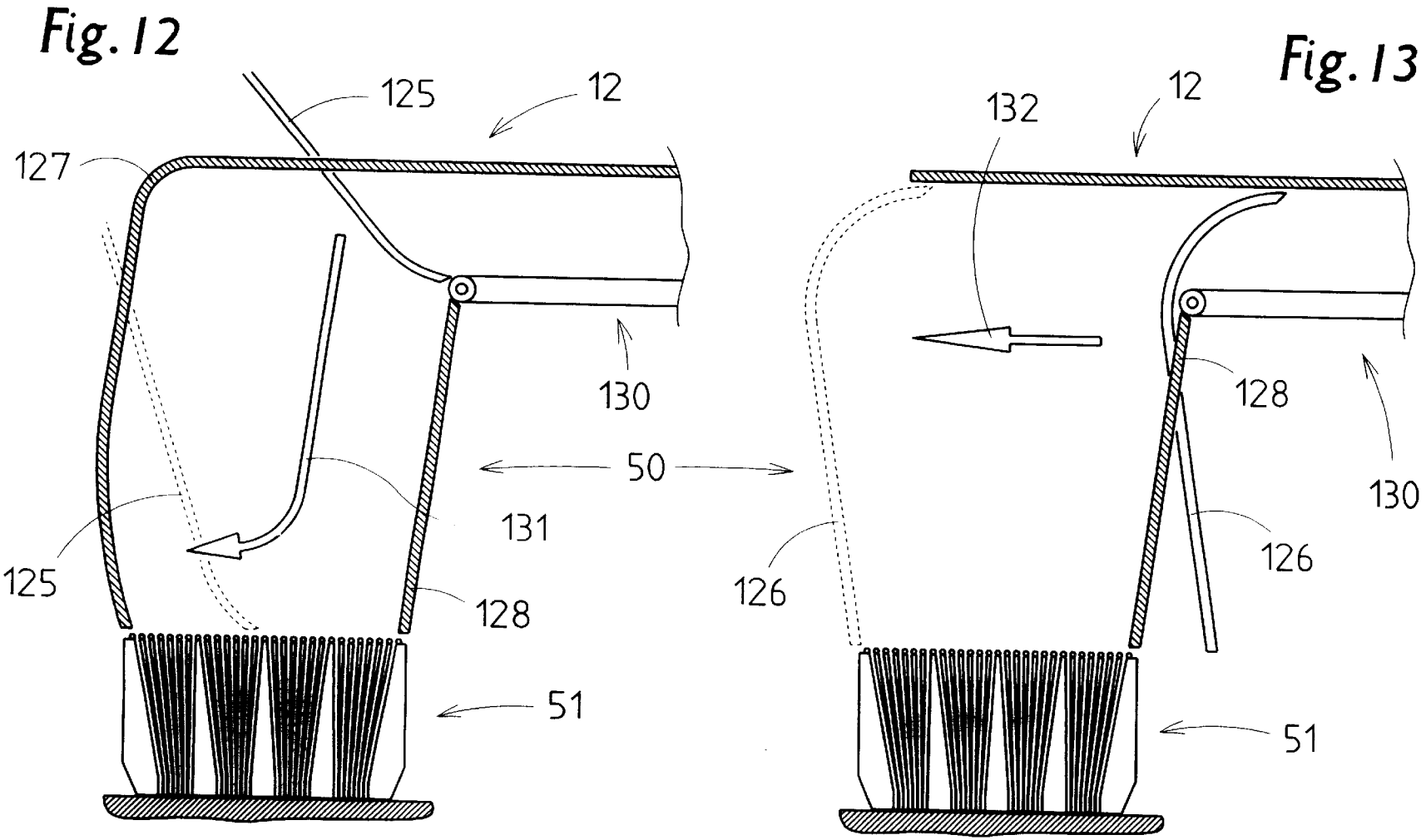

Further details of the invention concern the configuration and actuation of guide and boundary elements. Exemplary embodiments of the apparatus according to the invention are explained in more detail below with reference to the drawings, in which:

FIG. 1 shows a schematic side view of an apparatus for feeding cigarettes to a packaging machine, FIG. 2 shows, on an enlarged scale, a detail of the apparatus, namely a collecting container, in a vertical section along section plane II—II of FIG. 1, FIG. 3 shows, likewise on an enlarged scale, the detail according to FIG. 2 in a horizontal section along section plane III—III of FIG. 1, FIG. 4 shows, in a vertical section along section plane IV—IV in FIG. 1, a region of a horizontal conveying section which adjoins the collecting container, FIG. 5 shows, on an enlarged scale, a detail in the region of a cigarette magazine, namely a vertical section along section plane V—V of FIG. 1, FIG. 6 shows, on an enlarged scale, a horizontal section through the top region of the cigarette magazine along the staggered section plane VI—VI of FIG. 1, FIG. 7 shows a further detail in the region of the cigarette magazine, namely a horizontal section along section plane VII—VII of FIG. 5, FIG. 8 shows, on a further enlarged scale, a detail of the cigarette magazine in vertical section along the section plane VIII—VIII of FIG. 9, FIG. 9 shows, on an enlarged scale, a detail from the region of the cigarette magazine, namely a section along section plane IX—IX of FIG. 5, FIG. 10 shows a sub-region of a conveying apparatus for cigarettes in side view and in vertical section, FIG. 11 shows a cross section of the apparatus according to FIG. 10 along section plane XI—XI, FIG. 12 shows a further exemplary embodiment of a cigarette-conveying apparatus in side view and in vertical section, FIG. 13 shows an illustration similar to FIG. 12 for a further exemplary embodiment of a cigarette-conveying apparatus.

The drawings deal with the handling of cigarettes in conjunction with a packaging machine (not shown). The cigarettes—coming from a maker or storage—are introduced into a collecting container 10, and pass from the latter into a horizontal conveying section 11 and, finally, into a cigarette magazine 12. Cigarette groups are removed, as packaging units, from the latter in a known manner, to be precise by being pushed out by means of pushers 129 (FIG. 5).

For the introduction of the cigarettes, the collecting container 10 is open on the top side. Side walls 13, 14 are spaced apart from one another at a distance which is somewhat greater than the length of the cigarettes. Accordingly, the latter are arranged transversely in the collecting container 10. On the underside, the collecting container 10 is bounded by a belt conveyor 15, of which the width corresponds approximately to the length of the cigarettes. In the longitudinal direction, the belt conveyor 15 corresponds approximately to the length of the collecting container 10.

On one narrow side, the collecting container 10 is bounded by an upright transverse wall 16. On the opposite side, the collecting container 10 is adjoined by the conveying section 11. The latter is bounded at the bottom by a removal conveyor 17, a belt. Side walls 18, 19, together with the removal conveyor 17, form an elongate, channel-like conveying region.

In a region remote from the collecting container 10, the conveying section 11 merges into the cigarette magazine 12 or the conveying section 11 terminates on top side of the cigarette magazine 12.

The cigarettes can be fed to the apparatus or the collecting container 10 in various ways. In the present case, the cigarettes are fed by way of known transporting containers, that is to say so-called trays 20. These are containers which are open on a large-surface-area side and on the underside. Transversely arranged cigarettes 21 completely fill the tray 20. The tray 20 is positioned, by way of an open narrow side 22, on the collecting container 10, which is open at the top. In this case, the tray 20 extends over the entire length of the collecting container 10. The contents, namely the cigarettes 21, pass into the collecting container 10 under their own weight.

During continuous operation of the packaging machine and of the cigarette feed described here, the entire apparatus is completely filled with cigarettes. Once the installation has been emptied, in particular for a changeover of the cigarette brand, the cigarettes 21 have to be introduced from the tray 20 into the empty collecting container 10. In order to ensure ordered transfer of the cigarettes 21 to the collecting container 10, the latter is assigned guide elements for the cigarettes 21. These are carrying or supporting elements which are moved downwards with the cigarettes 21 in the collecting container 10 until the collecting container 10 has gradually been completely filled. The downward movement is established here such that impairment of the cigarettes 21 or incorrect positioning of the same is avoided.

The guide elements comprise guide plates 23. In a top, starting position (FIG. 1, FIG. 2), the guide plates 23 are located on the underside of the tray 20 or on the open narrow side 22 of the same. The contents of the tray 20 rest on the guide plates 23, which extend over the entire length of the collecting container 10. For introducing the cigarettes 21 into the collecting container 10, the guide plates 23 are moved downwards at a reasonable speed until they directly reach the bottom boundary of the collecting container 10, namely until they butt against the belt conveyor 15. The guide plates 23 are then moved out of the region of the collecting container 10, to be precise beneath the side wall 14, which for this purpose terminates at a distance above the plane of the belt conveyor 15 (FIG. 2).

The guide plates 23 can be moved by a drive arranged outside the collecting container 10. For this purpose, the side wall 14 has arranged in it upright slits 24 through which correspondingly narrow webs 25 pass. The guide plates 23 are connected to the drive, that is to say to a common transverse carrier 26, via said webs 25. Said transverse carrier is provided with a vertical drive. (Two) horizontal guide rods 27 are connected to the transverse carrier 26. The guide rods 27 are mounted in sleeve-like supporting bearings 28 of a carrying frame, namely of a transversely directed carrying rail 29. This, in turn, can be moved up and down, the guide plates 23 being carried along in the process. Ends of the carrying rail 29 are connected to a carrying member 30 which has a bore with an internal thread for receiving an upright spindle 31. The carrying member 30 is connected laterally to a guide member 32, which can be moved with sliding action on an upright supporting rod 33. Accordingly, with the aid of the (two) spindles 31, the guide plates 23 can be moved up and down in the collecting container 10 or outside the same.

For the transverse movement of the guide plates 23 out of the collecting container 10 (at the bottom) and for the reintroduction in the top region of the collecting container 10, use is made of a horizontal drive. This is constituted by (two) (pressure-medium) cylinders 34. These are likewise mounted on the carrying rail 29. Piston rods are connected to the transverse carrier 26.

The guide element in the collecting container 10 comprises a plurality of, namely four, adjoining guide plates 23. A further special feature is that these guide plates 23 can be moved past (stationary) fittings within the collecting container 10. These are distributing elements 35 of droplet design. These cause the cigarettes 21 to be distributed in a favorable manner within the collecting container 10 for the handling and/or transportation of said cigarettes, with the result that the collecting container is always completely full during operation.

The distributing elements 35 are of comb-like design, that is to say they comprise a preferably centrally arranged carrying webs 36 and a plurality of spaced-apart transverse webs 37. These transverse webs 37 each have the contour of a droplet or the configuration which is necessary for the desired effect (which can be seen in FIG. 1). In the case of the present exemplary embodiment, three distributing elements 35 are arranged in the collecting container 10, to be precise three distributing elements of different sizes and heights. The carrying webs 36 are connected to one of the side walls, namely to the side wall 14 of the collecting container 10.

The subdivision of the guide plates 23 is determined by the arrangement of the distributing elements 35. For continuous support of the cigarettes 21 over the entire length of the collecting container 10, the guide plates 23 have to be arranged such that they can be moved past the distributing elements 35. For this purpose, the regions of the guide plates 23 which are directed towards the distributing elements 35 are of comb-like design, with protrusions 38 and depressions 39. In this case, the protrusions 38 pass into the gaps formed between the transverse webs 37, while, conversely, the transverse webs 37 of the distributing elements 35 pass into the depressions 39 when the guide plates 23 designed in this way are moved past the distributing elements 35.

The transfer of the cigarettes 21 to the conveying section 11 is also configured in a specific manner. The lateral boundaries, namely the side walls 18 and 19, are expediently designed as a continuation of the side walls 13, 14 of the collecting container 10. The bottom boundary or support for the cigarettes 21 forms the removal conveyor 17, which directly adjoins the belt conveyor 15 of the collecting container 10.

Opposite the transverse wall 16, the collecting container 10 is provided with a termination, with the result that the cigarettes 21 can be introduced into the collecting container 10 without the cigarettes (initially) passing into the region of the adjoining conveying section 11. For this purpose, a transverse wall 40 is arranged opposite the transverse wall 16. A bottom sub-region of the transverse wall 40 is designed as a moveable adjustment wall 41 and can be displaced in the direction of the conveying section 11 (above the removal conveyor 17). This produces a lateral opening in the collecting container 10.

The adjustment wall 41 is connected to an actuating mechanism, namely to a drive belt 42, on which the adjustment wall 41 is fastened by way of a carrying member 43. The carrying member 43 is mounted displaceably on a (horizontal) guide rail 44. The drive belt 42 is driven in one direction or the other via one of the deflecting rollers 45.

Once the collecting container 10 has been sufficiently filled with cigarettes 21 the adjustment wall 41 is moved out of the closed position (FIG. 1) along the conveying section 11 by the drive belt 42, to be precise in accordance with the feed of cigarettes 21, this establishing, within the conveying section 11, a continuous, uninterrupted cigarette stream. In this case, the adjustment wall 41 moves as far as an end position above the cigarette magazine 12 (dashed lines in FIG. 1). The conveying section 11 has a corresponding cigarette stream over the entire length.

On the top side, the cigarette stream is provided with a deformable covering which can be adapted to the contour of the cigarette stream, namely a roller chain 46 of known design. The latter rests predominantly under its own weight on the top side of the cigarette stream. A sensor 47 monitors the height of the cigarette level.

The roller chain 46 can be moved with the adjustment wall 41 and therefore has one end fastened in the top region of the adjustment wall 41. The other, free end of the roller chain 46 is moveable and is thus connected to a moveable retaining member 48. The latter is fastened on the drive belt 42 and is guided on the guide rail 44. In the starting position according to FIG. 1, that is to say with the adjustment wall 41 in the region of the collecting container 10, the roller chain 46 is drawn predominantly out of the region of the conveying section 11 and extends above the same. When the adjustment wall 41 is extended, the roller chain runs, corresponding to the movement of the adjustment wall 41, into the conveying section 11 as a top covering of the cigarette stream. Since the roller chain 47 does not run in a tensioned, rectilinear formation, there is provided a compensating mechanism which allows the non-uniform contour of the roller chain 46. This mechanism is a compensating cylinder 49. The latter is provided on the retaining member 48 by way of a corresponding mount, that is to say it is moved back and forth with said retaining member. Depending on the desired contour of the roller chain 46, the compensating cylinder 49 releases additional length of roller chain 46 by virtue of a piston rod being extended.

The cigarette magazine 12 is also designed in a specific manner in order to allow careful, guided filling with cigarettes 21 in accordance with the feed of the same.

The cigarette magazine 12 comprises, in a basically known manner, a (top) storage part 50 and a bottom, shaft part 51. The cigarette magazine 12 or its storage part 50 adjoins the conveying section 11, namely in the region of a bottom conveying plane, with the result that the cigarettes 21 are introduced into the storage part 50 from above. The cigarettes 21 pass downwards into the region of the shaft part 51 under their own weight. Said shaft part comprises a plurality of (four) shaft groups 52 and these, in turn, each comprise a plurality of shafts 53 located closely one beside the other. The shafts 53 of a shaft group 52 run in a slightly slanting position (upright) with respect to one another, that is to say they are spaced apart from one another by a distance which decreases in a downward direction (FIG. 9). Pushed out of the shaft group 52 at the bottom in each case are cigarette groups which correspond to the contents of a cigarette pack. The shafts 53 of a shaft group 52 are separated from one another by shaft walls 54 which have a width which decreases in the downward direction (FIG. 9).

The storage part 50 on the one hand, and the shaft part 51, on the other hand, are assigned separate guide elements for the cigarettes. Conveying plates 55, 56, 57 are provided for the storage part 50 and, in terms of construction and functioning, are analogous to the guide plates 23 of the collecting container 10. A plurality of, namely three, such conveying plates 55, 56, 57 are arranged one beside the other and form continuous support for the cigarettes 21. In the region of the storage part 50, the cigarette magazine 12 is bounded by mutually opposite longitudinal walls 58, 59 and transverse walls 60, 61. The longitudinal walls 58, 59 are spaced apart from one another by a distance which is adapted to the length of the transversely arranged cigarettes 21. The storage part 50 has a downwardly widening form, that is to say as the distance between the transverse walls 60, 61 increases. These walls are angled half way up (FIG. 1). The longitudinal walls 58, 59 are adapted to the contour of the storage part 50.

The conveying plates 55, 56, 57 can be moved in the downward direction within the storage part 50, fed cigarettes 21 being carried along in the process. Provided outside the storage part 50 is a mechanism which is likewise designed analogously to the mechanism for the guide plates 23. These are each connected to a common crossmember 62 outside the storage part 50, adjacent to the longitudinal wall 58. Each conveying plate 55, 56, 57 is connected to the common crossmember via one or two narrow webs 63. The webs 63, in turn, pass through upright slits 64 in the longitudinal wall 58. The webs 63 are moved downwards in these slits 64. The crossmember 62 is connected to a carrying means which can be moved up and down, namely to a crossbar 65. The latter is mounted at the ends in each case on an upright spindle 67 by way of a carrying member 66 with internal thread. The spindles are rotatable, as a result of which the carrying means, namely the crossbar 65, is moved upwards and downwards with the elements provided thereon.

The crossmember 62 is mounted on the crossbar 65 in a transversely displaceable manner, to be precise via guide rods 68 which can be displaced in sleeve-like bearing members 69 provided on the crossbar 65. The transverse movement of the crossmember 62 is brought about by cylinders 70 which are provided on the crossbar 65 and of which the piston rod 71 is connected to the crossmember 62. For upright guidance, use is made of carrying rods 72 on which the crossbar 65 and/or the carrying member 66 is mounted in a moveable manner by way of a sliding body 73. The webs 63 are of angled design (FIG. 5), with the result that, in the bottom position (FIG. 5), the crossmember 62 is positioned at a distance from the bottom end region of the storage part 50.

In the configuration of the conveying plates 55, 56, 57, account is taken of the non-uniform cross section of the storage part 50 over the height of the same. The border-side conveying plates 55, 57 are of comb-like design, with elongate carrying fingers 74 and elongate recesses 75 arranged between the same, on the side directed towards the transverse walls 60, 61. Correspondingly, the transverse walls 60, 61 are of comb-like design in the top and central regions, so in the regions of the smaller transverse dimensions, that is to say they comprise upright, spaced-apart wall webs 76 with wall slits 77 formed between them. In the top, narrower region of the storage part 50, the conveying plates 55, 57 pass, by way of the carrying fingers 74, through the transverse walls 60, 61, that is to say through the wall slits 77, and are located outside the storage part 50. The conveying plates 55, 57 are dimensioned and arranged such that, in the bottom, wide region of the storage part 50, they are located entirely within the same, that is to say within the transverse walls 60, 61. Accordingly, in the bottom, wider part, the transverse walls 60, 61 are continuous, without wall slits 77 (FIG. 6, on the right).

A further special feature is achieved by fittings within the storage part 50. These are droplet-like directing elements 78 for the cigarettes 21. Said directing elements are positioned at a slant and cause cigarettes 21 to be deflected to the sides, that is to say in the direction of the more widely spaced-apart transverse walls 60, 61 in the bottom region of the storage part 50. The directing elements 78 are designed analogously to the distributing elements 35 in the collecting container 10. Each directing element 78 comprises an essentially upright carrying web 79 which is connected, as an element which projects on one side, to a longitudinal wall 58. A plurality of transversely directed shaped webs 80 are spaced apart from one another on the carrying web 79. These shaped webs 80 have the contour of the directing elements 78 (for example corresponding to FIG. 1). Gaps 81 are formed between the shaped webs 80, which are arranged in a comb-like manner on both sides of the carrying web 79.

The conveying plates 55, 56, 57 are adapted to the configuration of the directing elements 78, that is to say they are provided (likewise) with carrying fingers 82 on the sides directed towards said directing elements. These carrying fingers fit into the gaps 81 between the shaped webs 80, with the result that the conveying plates 55, 56, 57 can be moved past the directing elements 78 without disruption during the downward movement. Nevertheless, the cigarettes 21 are supported by the conveying plates 55, 56, 57 outside the region of the directing elements 78 over the full length and width of the storage part 50.

In the bottom region of the storage part, the conveying plates 55, 56, 57 are moved out laterally of the storage part and, outside the same, are moved back into the top, starting position. For this purpose, the longitudinal wall 58 terminates at a corresponding distance above the shaft part 51, while the opposite longitudinal wall 59 also extends continuously in the region of the shaft part 51.

In the region of the shaft part 51, the cigarettes 21 are guided and/or supported in a specific manner. Each shaft 53 is assigned a carrying or supporting element which can be moved downwards within the shaft 53. Said element is constituted by thin carrying bars 83 which can be moved downwards approximately centrally within the shaft 53, the respectively bottom cigarette 21 resting on the horizontal carrying bar 83.

The carrying bars 83 pass into the shafts 53 from the outside. An outer wall 84—beneath the longitudinal wall 58 of the storage part 50—is provided with upright slits 85 which follow the direction of the shafts 53 and run approximately centrally in relation to each shaft 53. The slits 85 are slightly wider than the diameter of the carrying bars 83.

Outside the shaft part 51, the carrying bars 83 are arranged on a common, transversely directed carrying element, namely on a carrier 86. The carrying bars 83 are designed and arranged such that they can follow the contours or the progression of the shafts 53 during the downward movement. For this purpose, the carrying bars 83 can be moved transversely, to be precise by transverse displacement in the longitudinal direction of the carrier 86. The latter is designed as a hollow body. The carrying bars 83 are mounted displaceably within the carrier 86. The carrying bars 83 pass out of the carrier 86 via a side slit 87 in the same.

For the transverse movement of the carrying bars 83, the latter are provided on individually moveable carrying elements, namely on a roller mount 88 within the carrier 86. Each roller mount 88 is mounted within the carrier 86 by way of a plurality of, namely four, running rollers 89. In this case, the carrier 86 is shaped so as to form a top and bottom running profile 90. The running rollers 89 of a roller mount 88 can be moved in a form-fitting manner in each case in said running profile. For space reasons, the arrangement is such that the carrying bars 83, which follow one after the other in the transverse direction, are arranged alternately in the top and bottom running profiles 90.

The transversely directed compensating movements of the carrying bars 83 are achieved automatically during the movement within the shafts 53. In this case, the slits 85 act as guides for transmitting the sideways movements to the roller mount 88.

In a bottom position, at a distance above the bottom ends of the shafts 53, the carrying bars 83 are drawn out of the shafts 53 (dashed-line position at the bottom of FIG. 5). For this purpose, the carrier 86 for the carrying bars 83 can be moved transversely, that is to say out of the engagement position of the carrying bars 83 (FIG. 7, on the left) into a drawn-back position (FIG. 7, on the right). The carrier 86 has its ends provided on a guide 91 which, for its part, is mounted displaceably on stationary carrying arms 92 oriented in the movement direction. Provided on each carrying arm 92 is an actuating cylinder 93, of which the piston rod 94 is connected to the guide 91 or to a transverse rod 95, which connects the guides 91 to one another.

Provided with a downward movement of the carrier 86 with the carrying bars 83 are upright spindles 96 on which a spindle nut 97 can be moved. Provided on the latter is a guide member 98 which can be displaced on an upright carrying rod 99. The latter may be a continuation of the carrying rod 72. The carrying apparatus for the carrying bars 83, namely the carrier 86, is connected to the guide member 98. Accordingly, the upward or downward movement takes place by virtue of the spindle 96 being rotated.

Transversely directed directing elements, namely oscillating rods 100 of known construction, are arranged in the region of the transition from the storage part 50 to the shaft part 51 of the cigarette magazine 12.

FIG. 10 and FIG. 11 show an example for the guided transportation of cigarettes 21 in the region of a horizontal and vertical conveying section. FIG. 10 hows a side view, in simplified form, of a U-shaped cigarette conveyor 101. This may be a sub-section of the transporting apparatus of a cigarette-production machine or packaging machine.

The cigarette conveyor 101 comprises a cigarette channel 103 which is bounded laterally by conveying elements or guide elements. In the region of an upright or vertical section of the cigarette channel 103, the latter is bounded on two opposite sides by endless conveying belts 104, 105. The outer conveying belt 104 extends from a bottom horizontal region and progresses in arcuate fashion as far as the top horizontal section. The conveying belt 105, which is positioned on the inside and opposite the outer conveying belt, is positioned parallel to the conveying belt 104 and likewise runs in arcuate fashion in the top and bottom regions. A cigarette stream 108 comprising transversely directed cigarettes 21 is conveyed within the cigarette channel 103, between mutually facing conveying strands 106, 107. The conveying belts 104, 105 are belts which are profiled in a specific manner and are guided on a hollow-box-like retaining profile 109 which is shaped correspondingly. The cigarette channel 103 is bounded laterally by channel walls 110, 111 which are shaped to correspond to the conveying progression. Outside the region of the conveying belts 104, 105, that is to say in the top and bottom horizontal regions of the cigarette conveyor 101, a top wall 112 or 113, respectively, is provided as a top covering and guide for the cigarette stream 108.

For the handling of the cigarettes 21 within the cigarette channel 103, first of all the beginning of the cigarette transportation, that is to say the introduction of the cigarette stream 108, is critical, specifically when the cigarettes 21 are fed via the top horizontal section of the cigarette channel 103 and thus pass into the vertical section. Likewise critical is the completion of the cigarette transportation, with upwardly directed conveying, specifically when there are no more cigarettes delivered in the bottom horizontal region, that is to say when the installation empties.

The cigarette conveyor 101 is assigned an auxiliary element for ensuring satisfactory cigarette transportation. Said auxiliary element is a conveying or carry-along element which, within the cigarette channel 103, is moved downwards with the cigarettes 21, in accordance with the conveying direction of the same, at the front end of the cigarette stream 108 (dashed arrow) or which is moved upwards with a cigarette stream 108 at the end of the latter (solid-line arrow).

The auxiliary element provided is an abutment plate 114 which can be moved within the cigarette channel 103. Said abutment plate largely fills the cross section of the cigarette channel 103.

The abutment plate 114 is mounted displaceably outside the cigarette channel 103, to be precise on a running rail 115 which is formed in a U-shaped manner corresponding to the cigarette channel 103. A running frame 116 is mounted, by way of roller pairs 117, 118, on opposite sides of the running rail 115. The running rail 115 is profiled (trapezoidal). The rollers of the roller pairs 117, 118, are of corresponding design in order to enclose the running rail 115 in a form-fitting manner.

The abutment plate 114 is provided on the running frame 116 via a carrying arm 119. The abutment plate 114 is seated eccentrically, that is to say by way of a corner-side border, on the carrying arm 119. A thin-walled web 120 passes, as a connection between the carrying arm 119 and abutment plate 114, into the cigarette channel 103 via a longitudinally running slit of the latter. The slit is formed laterally alongside the inner conveying belt 105.

For driving the abutment plate 114, the running frame 116 is driven, to be precise via a pinion 121 on the running frame 116. The pinion 121, which is driven by a motor 112, meshes with a rack 123 on the running rail 115.

The abutment plate 114 is moveable, to be precise pivotable about a bearing 124. In a top and bottom end position, the abutment plate 114 is pivoted out of the region of the cigarette stream 118, for example into the plane of the top wall 112, 113 (FIG. 10, at the bottom).

As the empty cigarette conveyor 101 is filled with cigarettes 21, the abutment plate 114 is located in a top position (dashed lines in FIG. 10) in the region of the horizontal conveying section. The incoming cigarettes run against the transversely directed abutment plate 114. The latter is moved downwards with the conveyed cigarette stream 108 into the bottom position, which is shown by solid lines. The cigarette channel 103 is then filled up to this position. The transportation in the horizontal region of the cigarette conveyor 101 continues without support of the abutment plate 114.

Conversely, when the cigarette feed is established during transportation of the cigarette stream 108 from the bottom horizontal part upwards to the top horizontal section, that is to say the installation is being emptied, the abutment plate 114 runs at the end of the cigarette stream 108 from the bottom position into the top position. In this case, the end of the cigarette stream is supported by the abutment plate 114.

The cigarette stream 108 is detected in the top horizontal section of the cigarette conveyor 101, and likewise in the bottom horizontal section, by monitoring elements, to be precise by optoelectronic sensors 102. These control the movement of the abutment plate 114.

FIG. 12 and FIG. 13 show other examples for the handling of cigarettes during introduction into a container. The exemplary embodiment here concerns a cigarette magazine 12 and/or the configuration of the (top) storage part 50. The cigarettes 21 are fed in the top region of the container or of the cigarette magazine 12 by a horizontal cigarette conveyor 130. For the guided and regulated filling movement of the cigarettes within the cigarette magazine 12, in particular during downward movement, there is provided a moveable guide element which is mounted outside the container or cigarette magazine and is in a configuration of a guide wall 125 or 126. The guide walls 125, 126, as described in principle, are of comb-like design and pass through slits in the walls of the container or cigarette magazine 12 by way of webs. The webs, which extend within the container, support and guide the cigarettes during the filling operation.

The guide walls 125, 126 are positioned in a top, starting position (FIG. 12, FIG. 13) such that the incoming cigarettes run against the guide walls 125, 126. These are then moved corresponding to the feed of cigarettes, in a manner appropriate for this specific purpose, within the container or cigarette magazine 12 along with the cigarettes, to be precise in accordance with the arrows 131 and 132. Accordingly, in the case of the exemplary embodiment according to FIG. 12, the guide wall 125 is first of all moved in the downward direction and, once a bottom, end position has been reached, is moved sideways out of the container or cigarette magazine 12, with the result that the latter is then completely filled with cigarettes. In the case of the exemplary embodiment according to FIG. 13, the guide wall 126, which is of arcuate configuration in the top region, is moved in the horizontal direction (arrow 132). The end position of the guide wall 126 is illustrated by dashed lines. In this position, the guide wall 126 forms a side wall of the container or the cigarette magazine. Accordingly in the case of this example, the container is filled with cigarettes first of all in a sub-region in a vertical direction and then in a horizontal direction.

In the case of the exemplary embodiment according to FIG. 12, an outer wall 127 of the container or cigarette magazine 12 is provided with upright slits for the through-passage of the comb-like guide wall 125, as well as a top, horizontal region of a covering. In the case of the exemplary embodiment according to FIG. 13, a side wall 128, which is located opposite the outer wall 127, is of comb-like design, with the result that a bottom sub-region of the guide wall 126 can pass through slits of the side wall 128 during an initial phase of the filling operation.

What is claimed is:

1. Apparatus for transporting cigarettes lying transverse to the direction of transport, the apparatus comprising:

an upright container for transporting the cigarettes downward from an upper entry opening of said container to a bottom end thereof;

a support element on which the cigarettes lie as they are transported downward in said container; and a mechanism for moving said support element downward with the cigarettes and then upward, wherein said mechanism is adapted to move said support element in a lower end position thereof from within said container to the outside of said container in a horizontal transverse direction, return said support element to an upper initial position thereof by moving said support element outside said container, and move said support element by a reverse transverse motion thereof in the upper initial position back into said container when said container is at least partially empty, wherein:

a) said container is subdivided by dividing elements into a plurality of upright, adjacent paths of movement for the cigarettes;

b) each path of movement has disposed therein at least one of said support elements for movement of said support element in the associated path of movement to the lower end position in said container; and c) adjacently arranged said support elements are connected to each other outside of said container to form a common unit adapted to be moved up and down and transversely.

2. Apparatus according to claim 1, wherein said dividing elements comprise distributing elements disposed in said container and each said support element includes downwardly displaceable carrier plate elements, said distributing elements and said carrier plate elements having cooperating protrusions and guide fingers, respectively, configured to mesh at mutually facing sides in such a way that protrusions on said carrier plate elements fit within depressions of said distributing elements during the downward displacement of said carrier plate elements.

3. Apparatus according to claim 2, wherein said container includes at least one slanting wall that includes at least a region with upright wall slits and wall webs delimiting said wall slits, and said protrusions on said carrier plate elements extend through said wall slits during at least a portion of the downward displacement of said carrier plate elements.

4. Apparatus according to claim 1, wherein:

a) said support element includes a plurality of carrying bars;

b) said container comprises a cigarette magazine having a plurality of adjacently arranged shafts for rows of individual cigarettes arranged one above the other, each said shaft being adapted to accept therein one of said carrying bars for downward movement within said shaft along a movement path;

c) said carrying bars are connected to each other outside said shafts by a transverse carrier adapted to be moved downward by said mechanism for moving said carrying bars downward together; and d) said carrying bars pass through a plurality of slits in an outer wall of said container with each said slit conforming to the movement path of an associated said shaft; and e) said mechanism is adapted to withdraw said carrying bars from said slots in the horizontal transverse direction and return them to the upper initial position.

5. Apparatus according to claim 4, wherein said slits are obliquely disposed along the movement path and said carrying bars are transversely displaceable such that said carrying bars automatically follow an oblique movement path during downward movement thereof.

6. Apparatus according to claim 5, wherein each said carrying bar is attached to a roller mount with running rollers that are transversely displaceable in an upper and lower running profile of a hollow carrier.

7. Apparatus according to claim 1, wherein:

a) said support element comprises a plurality of carrier plates connected by webs to a transverse connecting member disposed outside said container;

b) said mechanism includes an actuating cylinder for moving said connecting member in the horizontal transverse direction; and c) during downward movement of said carrier plates said webs extend through slits in a wall of said container.

8. Apparatus for the transaxial transfer of cigarettes from a collecting container along a horizontal conveying section to a top side of a cigarette magazine arranged below said conveying section, the apparatus including a power-driven belt conveyor forming a lower boundary of said conveying section, wherein:

a) said collecting container has an opening for accepting an upright adjustable wall for closing said opening when said adjustable wall is proximate to an upright transverse wall facing said conveying section;

b) a mechanism moves said adjustable wall along said conveying section, in accordance with the discharge of cigarettes from said collecting container, to an end position offset from said cigarette magazine such that apertures for the cigarettes to enter said cigarette magazine are exposed in accordance with the discharge of cigarettes from said collecting container; and c) said mechanism is adapted to drive said adjustable wall back and forth by a drive belt between an initial position in which said adjustable wall is within said the opening in the transverse wall and an end position comprising the boundary of said conveying section above said cigarette magazine.

9. Apparatus for conveying cigarettes to enable the production of cigarette packs, the apparatus comprising a cigarette magazine configured with an upper storage part for the cigarettes and a lower shaft part having a plurality of upright shafts for ordered downward transport of the cigarettes, and a horizontal cigarette conveyor for introducing the cigarettes laterally into said upper storage part, wherein:

a) a supporting guide wall adapted to pass into said upper storage part from outside thereof, said guide wall being mounted for displacement in said upper storage part generally in the direction that the cigarettes are introduced into said upper storage part by said cigarette conveyor;

b) said guide wall has protrusions and depressions; and c) said upper storage part includes an outer wall having slits in at least an upper region thereof, said protrusions of said guide wall extending through said slits in said outer wall.

10. Apparatus for conveying cigarettes to enable the production of cigarette packs, the apparatus comprising a cigarette magazine configured with an upper storage part for the cigarettes and a lower shaft part having a plurality of upright shafts for ordered downward transport of the cigarettes, and a horizontal cigarette conveyor for introduc ing the cigarettes laterally into said upper storage part, wherein:

a) said upper storage part includes a guide wall movable generally in the direction that the cigarettes are introduced into said upper storage part by said cigarette conveyor from an initial position proximate to said cigarette conveyor to an end position defining a distal side wall of said upper storage part;

b) said guide wall has protrusions and depressions; and c) said upper storage part includes a second side wall proximate to said cigarette conveyor opposite said distal side wall, said second side wall having slits in at least a lower region thereof, said protrusions of said guide wall extending through said slits in said second side wall.

11. Apparatus for transporting a stream of cigarettes transversely arranged along a cigarette conveyor, the cigarette stream being delimited at an end or a beginning of the conveying path by a support element moveable along the conveying section in accordance with the conveying movement of the cigarette stream, wherein:

a) conveyor belts provide a cigarette conveyor for conveying the cigarette stream along a cigarette channel;

b) when the cigarette stream is in the cigarette channel an abutment plate is moveable into place in said cigarette channel in front of the cigarette stream and is moveable through said cigarette channel as a carrier element at a rear side of the cigarette stream when a cigarette feed is interrupted;

c) said abutment plate is connected to a running frame guided on a running rail mounted outside said cigarette conveyor; and e) a carrying arm on said running frame is connected through a slit in said cigarette conveyor to said abutment plate said cigarette channel.

* * * * *